US005514065A

United States Patent [19]

Noda et al.

[11] Patent Number: 5,514,065

[45] Date of Patent: May 7, 1996

[54] WEAR- AND SEIZING-RESISTANT ROLL FOR HOT ROLLING AND METHOD OF MAKING THE ROLL

[75] Inventors: Akira Noda; Toshiyuki Hattori; Ryosaku Nawata, all of Fukuoka, Japan

[73] Assignee: Hitachi Metals, Ltd., Japan

[21] Appl. No.: 343,508

[22] PCT Filed: Mar. 30, 1994

[86] PCT No.: PCT/JP94/00520

§ 371 Date: Feb. 3, 1995

§ 102(e) Date: Feb. 3, 1995

[87] PCT Pub. No.: WO94/22606

PCT Pub. Date: Oct. 13, 1994

[30] Foreign Application Priority Data

Mar. 31, 1993 [JP] Japan ..... 5-097080

[51] Int. Cl.[6] ..... B23P 15/00

[52] U.S. Cl. ..... 492/58; 492/54; 29/895.32

[58] Field of Search ..... 492/54, 58; 29/895.32, 29/895.3, 895, 458; 164/98

[56] References Cited

U.S. PATENT DOCUMENTS 4,958,422 9/1990 Oshima et al. .

FOREIGN PATENT DOCUMENTS

| | | |
|---|---|---|
| 60-23183 | 6/1985 | Japan . |
| 2-30730 | 2/1986 | Japan . |
| 61-26758 | 2/1986 | Japan . |
| 63-199092 | 8/1988 | Japan . |
| 63-235092 | 9/1988 | Japan . |
| 63-309393 | 12/1988 | Japan . |
| 3-81091 | 4/1991 | Japan . |
| 3-126838 | 5/1991 | Japan . |
| 4-141553 | 5/1992 | Japan . |
| 60-93328 | 4/1994 | Japan ..... 492/58 |

*Primary Examiner*—Irene Cuda

*Attorney, Agent, or Firm*—Finnegan, Henderson, Farabow, Garrett & Dunner

[57] ABSTRACT

A wear- and seizing-resistant roll for hot rolling has a composition consisting essentially, by weight, of 2.0–4.0% of C, 0.5–4.0% of Si, 0.1–1.5% of Mn, 1.0–7.0% of Cr, 2.0–10.0% of Mo, 2.0–8.0% of V and balance of Fe and inevitable impurities; and has a metal structure comprising a matrix substantially comprising martensite, bainite or pearlite, 0.5–5% in area ratio of graphite, 0.2–10% in area ratio of MC carbides and 40% or less in area ratio of cementite. The roll of the present invention is suitable for work roll in the latter stand of a finishing train of a hot strip mill.

14 Claims, 4 Drawing Sheets

WEAR- AND SEIZING-RESISTANT ROLL FOR HOT ROLLING AND METHOD OF MAKING THE ROLL

TECHNICAL FIELD

The present invention relates to a wear- and seizing-resistant roll for hot rolling which s required to have higher wear resistance and ability to withstand abnormal rolling operations, and particularly, to a wear- and seizing-resistant roll for hot rolling suitable for a work roll in the latter stand of a finishing train of a hot strip mill.

BACKGROUND ART

Conventionally, rolls having an outer layer of grain cast iron have been used in the latter strand of a finishing train of a hot strip mill. When grain rolls meet abnormal draw rolling, the grain rolls suffer from little seizing of rolled material as well as little occurring or extending of cracks, because the grain roll, in general, is excellent in seizing resistance. However, the grain roll is fairly inferior in wear resistance to a compound roll having an outer layer of high-speed steel material, which has is recently come to be widely used. Although the high-speed steel roll is excellent in wear resistance, such roll is susceptible to seizing of rolled material by abnormal draw rolling, resulting in ocurring or extending cracks due to the stress concentration at seizing portion by high pressure from back-up rolls or the rolled material.

It has been known that crystallization or precipitation of hard carbides such as MC, $M_2C$, etc is effective for improving wear resistance of a roll. Also, it has been known that crystallization of graphites which as a solid lubricant can improve seizing resistance of a roll. However, V, Mo, W which are hard carbide-forming elements are also white cast iron-forming elements. Therefore, it has been unable to crystallizing a suitable amount of graphite in high-speed steel roll containing a large amount of these white cast iron-forming elements to allow hard carbides and graphites to coexist.

To solve this problem, various attempts have been made. JP-B-60-23183 discloses a tough, wear-resistant roll for rolling mill made of a cast ironing a composition consisting of 2.2–2.9% of C, 0.8–1.5% of Si, 0.5–1.0% of Mn, 0.1% or less of P, 0.1% or less of S, 3.8–4.8% of Ni, 1.7–2.5% of Cr, 0.4–1.0% of Mo and balance substantially consisting of Fe. The roll has a structure comprising a matrix of martensite and/or bainite, carbides having an area ratio of 10–30% and graphites having an area ratio of 0.5–3%. The Shore hardness of the roll is 70–85. The roll of JP-B-60-23183, however, is insufficient in in wear resistance because of a small amount of carbides.

JP-A-61-26758 discloses a seizing-resistant compound roll having an outer layer of a composition consisting, by weight, of 1.0–2.0% of C, 0.2–2.0% of Si, 0.5–1.5 of Mn, 3.0% or less of Ni, 2–5% of Cr, 3–10% of Mo, 4.0% or less of V 0.1–0.6% of S and balance substantially consisting of Fe. In this roll, seizing resistance is intended to be improved by forming MnS, etc. However, it is now known that graphite is more effective than MnS for improving seizing resistance.

JP-A-2-30730 disclose a wear-resistant cast iron for use in a roll for hot or cold rolling, having a composition consisting, by weight, of 2.5–4.0% of C. 2.0–5.0% of Si, 0.1–1.5% of Mn, 3–8% of Ni, 7% or less of Cr, 4–12% of Mo, 2–8% of V and balance consisting of Fe and impurities. This cast iron contains graphites and hard carbides such as MC, $M_2C$, $M_6C$, $M_4C_3$, etc. in an area ratio of 20% or less. In this cast iron, an Si-containing inoculant such as Fe—Si alloy, etc. is added into a melt of a casting material to crystallize graphite. Specifically, in Example 1, an Fe—Si alloy is inoculated into a melt in a ratio of 0.3% based on Si to obtain a casting product in which the area ratio of graphite is 2% and the ratio of the area of hard carbides to the area of total carbides is 85%.

In case of a high-speed steel roll, however, it has been found that graphite does not crystallize in a sufficient amount by the inoculation method disclosed in JP-A-2-30730, because a sufficient effect of inoculation cannot be obtained by merely adding an inoculant into a melt at tapping of the melt.

It is difficult to insure a sufficient crystallization of graphite in an outer layer, namely, in a high-speed steel roll disclosed in WO 88/07594, namely, a wear-resistant compound roll comprising an outer layer of an iron-based alloy consisting, by weight, of 1.5–3.5% of C, 0.3–3.0% of Si, 0.3–1.5% of Mn, 2–7% of Cr, 9% or less of Mo, 20% or less of W, 3–15% of V and balance substantially consisting of Fe, and a steel shaft metallurgically bonded to the outer layer; and produced by a shell casting method.

Accordingly, an object of the present invention is to solve the above problem and provide a graphite-containing, high-speed steel roll for hot rolling excellent in both wear resistance and seizing resistance.

DISCLOSURE OF INVENTION

The wear- and seizing-resistant roll for hot rolling of the present invention has a composition consisting essentially, by weight, of 2.0–4.0% of C, 0.5–4.0% Si, 0.1–1.5% of Mn, 1.0–7.0% of Cr, 2.0–10.0% of Mo, 2.0–8.0% of and balance of Fe and inevitable impurities, and has a metal structure comprising a matrix, 0.5–5% in area ratio of graphite, 0.2–10% in area ratio of MC carbides and 40% or less in area ratio of cementite.

The wear- and seizing-resistant compound roll for hot rolling according to the present invention comprises an outer layer of a wear- and seizing-resistant iron-based alloy and a steel shaft metallurgically bonded to the outer layer, the iron-based alloy having a composition consisting essentially, by weight, of 2.0–4.0% of C, 0.5–4.0% of Si, 0.1–1.5% of Mn, 1.0–7.0% of Cr, 2.0–10.0% of Mo, 2.0–8.0% of V and balance of Fe inevitable impurities, and having a metal structure comprising a matrix, 0.5–5% in area ratio of graphite, 0.2–10% in area ratio of carbides and 40% or less in area ratio of cementite.

The method of producing the wear- and seizing-resistant compound roll for hot rolling according to the present invention is characterized in supplying an Si-containing inoculant at least in a vicinity of the bonding of the melt for the outer layer and the steel shaft.

Preferably, the method of producing the wear- and seizing-resistant compound roll for hot rolling according to the present invention comprises the steps of introducing the steel shaft concentrically into an inner space of a composite mold comprising a refractory mold surrounded by an induction heating coil and a cooling mold provided under the refractory mold concentrically therewith; pouring a melt of the m-based alloy into a space between the steel shaft and the composite mold; keeping the melt at a temperature between a primary crystal-crystallizing temperature and a temperature 100° C. higher than the primary crystal-crystallizing temperature un heating with stirring while sealing the surface of the melt by flux; moving the steel shaft downward concentrically with the composite mold to bring the melt into contact with the cooling mold hereby solidifying the melt to bond to the steel shaft so that the toter layer is continuously formed on the steel shaft body, during the formation of the outer layer an Si-containing inoculant is injected by means of wire-injection method into a vicinity of tile bonding portion of the melt and the steel shaft to crystallize particles in a sufficient amount.

BEST MODE FOR CARRYING OUT THE INVENTION

Figure 1:
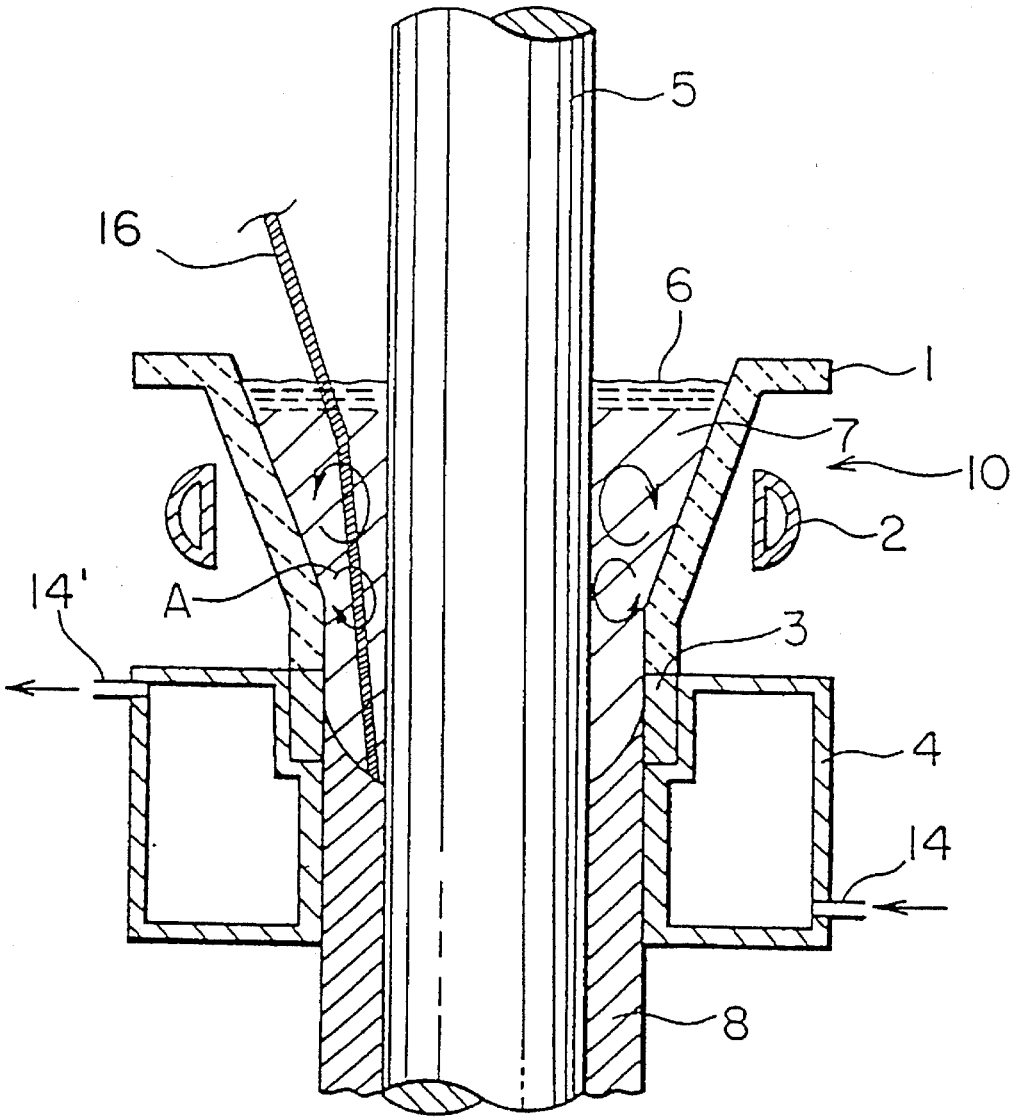
FIG. 1 is a schematic -sectional view showing an apparatus for producing the wear- and seizing-resistant compound roll for hot rolling according to the invention by a shell casting method.

[1] Wear- and seizing-resistant rot for hot rolling (a) Metal structure

The wear- and seizing-resistant roll for hot rolling of the present invention has the following metal structure.

(1) The content of the graphite particles is 0.5–5% by area ratio. A sufficient improvement in seizing resistance cannot be obtained by a graphite content less than 0.5%. A graphite content exceeding 5% deteriorates the mechanical strength of the resulting roll extremely. The preferred graphite content is 2–4%. The particle size of the graphite particles is 5–50 μm.

(2) To improve wear resistance, it is required that the hard carbides are well dispersed. To this end, MC carbides should be contained in an area ratio of 0.2–1%. Only insufficient wear resistance can be obtained by an MC content less than 0.2%. It is practically unable to contain the MC carbides exceeding 10% by area ratio due to the coexistence of the graphites. The preferred content of the MC carbides is 4–8%.

(3) Since the cementite, which is one of soft carbides, shows a little effect for improving wear resistance, the amount of the cementite is preferred to be minimized. However, the cementite and the graphite are generated in nearly the same condition. Therefore, it is impossible to allow the graphites only to crystallize without accompanied by the generation of cementite. When the content of the cementite exceeds 40% by area ratio, the toughness of the roll is deteriorated. The preferred area ratio of cementite is 1–30%.

(4) The roll may contain at east one of $M_2C$ carbides, $M_6C$ carbides and $M_7C_3$ carbides in an tea ratio of 0.2–20% in addition to the MC carbides. An area ratio less than 0.2% provides no sufficient effect, whereas an area ratio exceeding 20% deteriorates the toughness of the roll because the area ratio of the total carbides including the cementite becomes too large. The preferred area ratio of the carbides excluding the MC carbides is 4–15%.

(5) The matrix of the roll is preferred to substantially comprise martensite, bainite or pearlite.

(b) Composition

In order to meet the above structural requirements, the wear- and seizing-resistant roll for lot rolling of the present invention has the following composition.

(1) C: 2.0.–4.0 weight %

C is an indispensable element for forming hard carbides by bonding with the coexisting elements of Cr, V, Mo and W to enhance wear resistance as well as for crystallizing graphite particles to impart seizing resistant to the roll. When the content of C is less than 2.0 weight %, the amount of the hard carbides is too small and the graphite particles hardly crystallize. When the content of C is more than 4.0 weight %, the amount of the cementite and the hard carbides are too large to deteriorate the toughness of the roll. The preferred content of is 2.5–3.5 weight %, and more preferred content is 2.8–3.2 weight %.

(2) Si: 0.5–4.0 weight %

Si is a graphitizing element and is necessary to be contained in an amount of 0.5 weight % or more. When the content exceeds 4.0 weight %, the matrix of the resulting roll becomes brittle to decrease the toughness. In addition, Si is necessary to be inoculated in an amount of 0.1 weight % or more, preferably 0.1–0.8 weight % for crystallizing the graphites in a suitable amount. The Si content mentioned above means the total content of the Si originally contained in a melt of roll material and the Si inoculated into the melt. The total content of Si in the roll is preferably 0.8–3.5 weight %, and more preferably 1.5–2.5 weight %.

(3) Mn: 0.1–1.5 weight %

Mn has a function of deoxidizing a melt and fixing S contained as an impurity, and is necessary to be contained in an amount 0.1 weight % or more. When the content exceeds 1.5 weight %, retained austenite tends to be generated, making it difficult to maintain sufficient hardness. The preferred content of Mn is 0.2–1.0 weight %, and more preferred content is 0.3–0.6 weight %.

(4) Cr: 1.0–7.0 weight %

Cr is effective for maintaining sufficient hardness and wear resistance by generating bainite matrix or martensite matrix, and is necessary to be contained 1.0 weight % or more. When Cr is contained in excessively large amount, the crystallization of graphite is inhibited or the roughness of the matrix becomes low, as well as, Cr carbides such as $M_7C_3$ and $M_{23}C_6$ are generated. Such Cr carbides are lower than MC carbide or $M_2C$ carbides in hardness, so that improvement in wear resistance cannot be expected and the resulting roll becomes brittle. Therefore, the upper limit of the Cr content is 7.0 weight %. The preferred content is 1.0–5.0 weight %, and more preferably 1.5–3.0 weight %.

(5) Mo: 2.0–10.0 weight %

Mo is effective for increasing wear resistance because Mo forms hard $M_6C$, $M_2C$ carbides by bonding with C, and further, strengthens the matrix by dissolving thereinto. On the other hand, an excess Mo tends to inhibit the crystallization of graphite because Mo is a white cast iron-forming element. Therefore, the Mo content is 2.0–10 weight %, preferably 2.0–8.0 weight %, and more preferably 3.0–6.0 weight %.

(6) V: 2.0–8.0 weight %

V forms MC carbides by with C. This MC carbide have a Vickers hardness of 2500–3000 and is the hardest one among the carbides. Therefore, is the most effective, indispensable element for increasing wear resistance. However, an excess V inhibits the crystallization f graphite. Accordingly, the V content is 2.0–8.0 weight %, preferably 2.0–6.0 weight %, and more preferably 3.0–6.0 weight %.

(7) Ni: 0.2–4.0 weight %

In addition to the indispensable elements described above, the roll of the present lion may further contain Ni. Ni has functions to promote the crystallization of graphite and to improve the hardenability of the m, However, Ni shows no such functions when the Ni content is less than 0.2 weight %. On the other hand, when the content exceeds 4.0 weight %, the austenite is stabilized too much to make it difficult to transform into bainite or martensite. The preferred Ni content is 0.5–2.0 weight %.

(8) W: 2.0–10.0 weight %

In addition to the indispensable elements described above, the roll of the present invention may further contain W. W is effective for increasing wear resistance because W like Mo forms hard $M_6C$, $M_2C$ carbides by bonding with C, and further, strengthens the matrix by dissolving thereinto. )n the other hand, an excess W tends to inhibit the crystallization of graphite because W is a white cast iron-forming element. Therefore, the preferred W content is 2.0–10 weight %, and more content is 2.0–6.0 weight %.

(9) Co: 1.0–10.0 weight %

In addition to the indispensable elements described above, the roll of the present invent on may further contain Co. Although Co is effective for strengthening the matrix, an excess Co tends to decrease the toughness. Therefore, the Co content is 1.0–10.0 weight %. Co further has a function to make cementite instable to promote the crystallization of graphite. The preferred Co content is 3.0–7.0 weight %.

(10) Nb: 1.0–10.0 weight %

In addition to the indispensable elements described above, the roll of the present invention may further contain Nb. Nb like V forms MC carbides by bonding with C. Since this MC carbide, as described above, is the hardest me among the carbides, Nb is the most effective element for increasing wear resistance. However, an excess Nb inhibits the crystallization of graphite. Accordingly, the Nb content is preferably 1.0–10.0 weight %, and more preferably 2.0–6.0 weight %.

(11) Ti: 0.01–2.0 weight %

In addition to the indispensable elements described above, the roll of the present invention may further contain Ti. Ti forms oxy-nitrides by with N and O which are anti-graphitizing elements. Ti less than 0.01 weight % shows no such effect, and Ti up to 2.0 weight % is sufficient for the purpose in consideration of the contents of N and O. The more preferred Ti content is 0.05–0.5 weight %.

(12) B: 0.002–0.2 weight %

In addition to the indispensable elements described above, the roll of the present invention may further contain B. Although B has a function to make he carbides fine, B less than 0.002 weight % shows such function insufficiently. On the other hand, B exceeding 0.2 weight % ma the carbides instable. Accordingly, the B content is preferably 0.002–0.2 weight %, and more preferably 0.01–0.05 weight %

(13) Cu: 0.02–1.0 weight %

In addition to the indispensable elements described above, the roll of the present invention may further contain Cu. Cu like Co has a function to make cementite instable to promote the crystallization of graphite. Cu less than 0.02 weight % shows insufficient effect, whereas Cu less than 1.0 weight % results in reduced toughness. Accordingly, the Cu content is preferably 0.02–1.0 weight %, and more preferably 0 1-0.5 weight %.

(14) Balance

Beside the above elements, the roll consists substantially of Fe except for impurities. Major impurities are P and S, and it is preferred that P is 0.1 weight % or less and S is 0.08 weight % or less for preventing the toughness from decreasing.

[2] Wear- and seizing-resistant compound roll for hot rolling

The wear- and seizing-resistant roll for hot rolling of the present invention may be a compound roll. The outer layer of the compound roll is made of the alloy having the metal structure and the composition, both described above. The shaft of the compound roll, which bonds metallurgically to the outer layer, is made of steel including cast steel and forged steel. It is preferable that the shaft has a tensile strength of 55 $kg/mm^2$ or more and an elongation of 1.0% or more. This is because when used for rolling, the shaft is subjected to large rolling force, and a bending force is applied both ends of the shaft to compensate the deflection of the roll during the rolling operation, so the shaft should withstand such rolling force bending force.

In addition, the shaft should be strongly bonded to the outer layer made of the above iron-based alloy. Accordingly, the bonding strength of the outer la, interface should be higher than or equal to the mechanical strength of weaker one of the outer layer and the shaft.

[3] Production of the wear- and seizing-resistant roll for hot rolling

Since the material for he roll of the present invention is high speed steel, the roll is to be produced into a compound roll by a centrifugal casing method or a shell casting method. In both the casting methods, an Si-containing inoculant should be added to a melt having he above composition. Although the inoculating amount of Si is at least 0.1 weight %, the inoculant becomes difficult to dissolve in a melt uniformly when the inoculating amount of Si exceeds 0.8 weight %, resulting in uneven metal structure of the resulting outer layer.

The production of a compound roll is exemplified below in the shell casting method.

The shell casting method is basically disclosed in WO 88/07594. FIG. 1 shows an example of an apparatus for use in continuous shell casting method. This apparatus comprises a composite mold 10 comprising a tunnel-shaped refractory mold 1 having a tapered portion and a cylindrical portion and a cooling mold 4 provided under and concentrically with the refractory mold.

The refractory mold 1 is surrounded by an annular induction heating coil 2, and a lower end of the refractory mold 1 is provided with a concentric, annular buffer mold 3 having the same inner diameter as that of the refractory, mold 1. Attached to a lower end of the buffer mold 3 is a cooling mold 4 having substantially the same inner diameter as that of the buffer mold 3. Cooling water is introduced into the cooling mold 4 through an inlet 14 and discharged through an outlet 14'.

A roll shaft 5 is inserted into a composite mold 10 having the above structure. The shaft 5 is provided with a closure member (not shown) having substantially the same diameter as that of an outer layer to be formed at a lower end of the shaft or at a position appropriately separate from the lower end of the shaft. The lower end of the shaft 5 is mounted to a vertical movement mechanism (not shown). A melt 7 is introduced into a space between the shaft 5 and the refractory mold 1, and a surface of the melt 7 is sealed against the air by a melted flux 6. The melt 7 is stirred by convection in the direction shown by the arrow A in FIG. 1. Next, the shaft 5 is gradually moved downward together with the closure member fixed thereto. Due to the downward movement of the shaft and the closure member the melt 7 is lowered and begins to be solidified when contacted with the buffer mold 3 and the cooling mold 4. By this solidification, the shaft and the outer layer are completely metallurgically The surface of the melt held in the refractory mold 1 is also lowered together with the descent of the shaft 5 and the close member, but a fresh melt is appropriately supplied to keep the melt surface at a certain level. By successively repeating the descent of the shaft 5 and pouring of the melt 7, the melt 7 is gradually solidified from below to form an outer layer 8.

During the above continuous casting, an Si-containing inoculant is injected into the melt 7 held in the refractory mold 1. Ca—Si alloy is preferably used as the Si-containing inoculant while a sufficient graphite crystallization cannot be attained by Fe—Si alloy. The Si content in the Ca—Si alloy is 55–65 weight %.

The inoculant should be injected just before the initiation of solidification of the melt because the duration of the inoculating effect is only about 5 minutes. Therefore, the inoculation by merely mixing the inoculant with the melt 7 or ladle inoculation is not employed, but inoculation is conducted by injecting a wire 16 containing the inoculant into the portion as close to the solidifying portion of the met as possible. With this so-called wire-injection method, the resulting solidified outer layer 8 contains a sufficient amount of crystallized graphite particles.

The wire 16 containing the inoculant is preferred to be made of mild steel for avoiding the change of the composition of the outer layer. The wire 16 is of having an outer diameter of about 6–14 mm and an inner of 5.6–13 mm, and the inner space of the wire is filled with the Si-containing inoculant. The wire 16 made of mild steel is fused in the melt 7 to allow the Si-containing inoculant contained therein to be exposed and fused in the melt thereby inoculating Si. For effectively inoculating Si, the tip of the wire 16 is kept at the vicinity of the surface of solidifying melt.

The compound roll thus prepared is further subjected to heat treatment such as hardening and tempering according to known methods.

The present invention will be explained in further detail by means of the following Examples.

EXAMPLE 1

Figure 2:
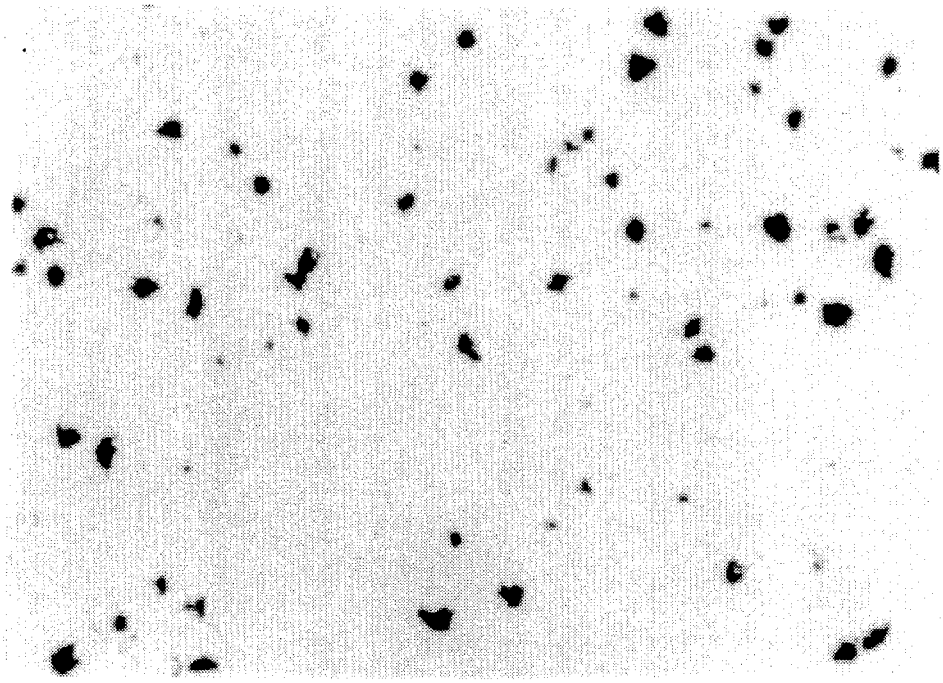
FIG. 2 is a microphotograph (×100) showing the metal structure of the test roll No. 2 in Example 1 after diamond polishing.
Figure 3:
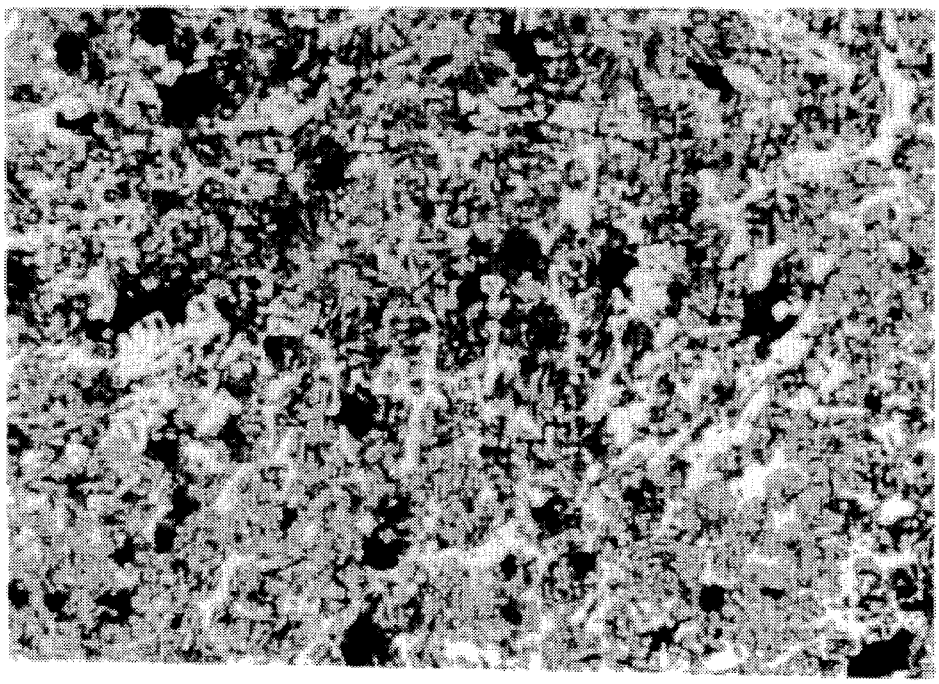
FIG. 3 is a microphotograph (×100) showing the metal structure of the test roll No. 2 in Example 1 after etching treatment with picric acid.
Figure 4:
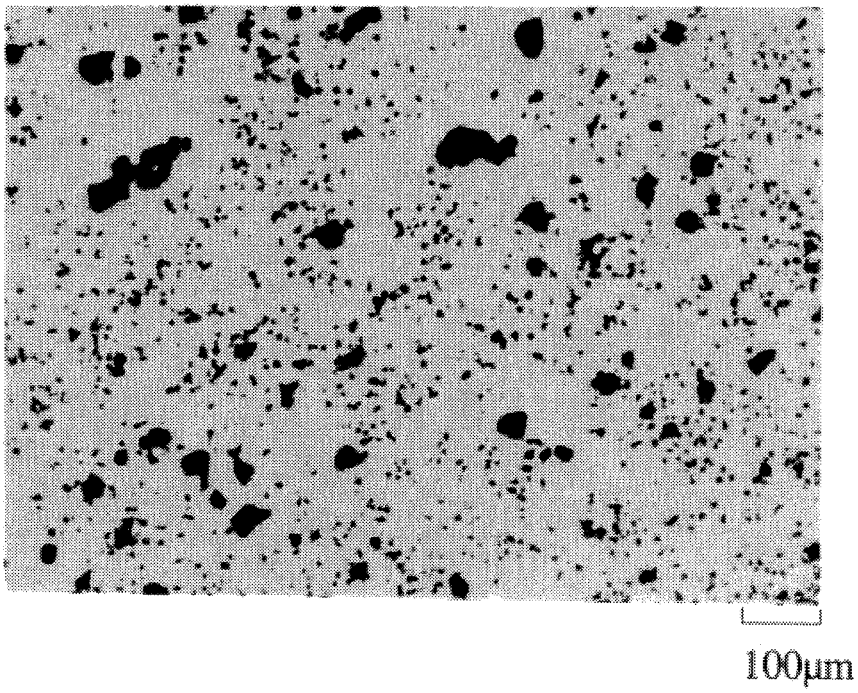
FIG. 4 is a microphotograph (×100) showing the metal structure of the test roll No. 2 in Example 1 after electrolytic etching.

Each melt of 1550° C. having a composition shown in Table 1 was poured at a pouring temperature of 1400° C. into a sand mold of 100 mm diameter and 100 mm depth containing a Ca—Si alloy inoculant in 0.2 weight %. The cast product was subjected to hardening from 1100° C. and subsequently to tempering at 550° C. repeatedly three times to prepare each test roll. In Table 1, the test rolls Nos. 1–7 are within the present invention, the test roll No. 8 is made of a grain cast steel, and the test roll No. 9 is made of a high speed steel with no of Si. Microphotographs of the metal structures at the position 50 mm distant from the bottom of the test roll No. 2 are shown in FIGS. 2–4. Specifically, FIG. 2 shows the metal structure of the surface subjected to diamond polishing. In FIG. 2, the black portion is graphite particles and the white ground portion is carbides and matrix. FIG. 3 shows the metal structure of the surface subjected to etching with picric acid. The etching treatment made it possible observe the structures of tempered bainite matrix, martensite x and carbides. FIG. 4 shows the metal structure of the surface subjected to electrolytic etching with chromic acid. By the electrolytic etching with chromic acid, MC carbides came possible to observed as black portion which also includes graphite particle: All the carbides (MC carbides, $M_2C$ carbides, $M_6C$ cementite, etc.) can be observed by etching with a solution of ammonium persulfate. The area ratios of the graphite and carbides were measured by an image analyzer (manufactured by Avionics Co. Ltd.). The results are shown in Table 2.

TABLE 1

(weight %)

| Test roll No. | C | Si | Mn | Ni | Cr | Mo | V |
|---|---|---|---|---|---|---|---|
| 1 | 2.9 | 1.9 | 0.5 | 1.0 | 2.8 | 3.1 | 4.5 |
| 2 | 3.0 | 2.0 | 0.5 | 0.9 | 3.0 | 2.9 | 4.5 |
| 3 | 3.1 | 2.0 | 0.5 | 1.2 | 3.1 | 2.5 | 4.0 |
| 4 | 3.3 | 2.7 | 0.4 | 0.8 | 2.7 | 3.3 | 3.0 |
| 5 | 3.0 | 2.0 | 0.5 | 0.8 | 2.3 | 2.2 | 3.8 |
| 6 | 2.9 | 1.8 | 0.5 | 0.9 | 2.5 | 2.1 | 4.5 |
| 7 | 3.0 | 2.0 | 0.5 | 0.9 | 2.2 | 4.3 | 4.4 |
| 8(1) | 3.1 | 1.0 | 0.7 | 4.5 | 1.8 | 0.3 | — |
| 9(2) | 2.1 | 0.8 | 0.4 | 0.5 | 6.2 | 3.5 | 5.9 |

| Test roll No. | W | Co | Nb | Ti | B | Cu |
|---|---|---|---|---|---|---|
| 1 | — | — | — | — | — | — |
| 2 | 2.2 | — | — | — | — | — |
| 3 | 2.1 | 5.2 | — | — | — | — |
| 4 | — | — | 2.3 | — | — | — |
| 5 | 3.1 | — | — | 0.5 | — | — |
| 6 | 2.5 | — | — | — | 0.05 | — |
| 7 | 3.0 | — | — | — | — | 0.2 |
| 8(1) | — | — | — | — | — | — |
| 9(2) | 2.2 | — | — | — | — | — |

Note:
(1)Grain roll
(2)High speed steel roll

EXAMPLE 2

Figure 5:
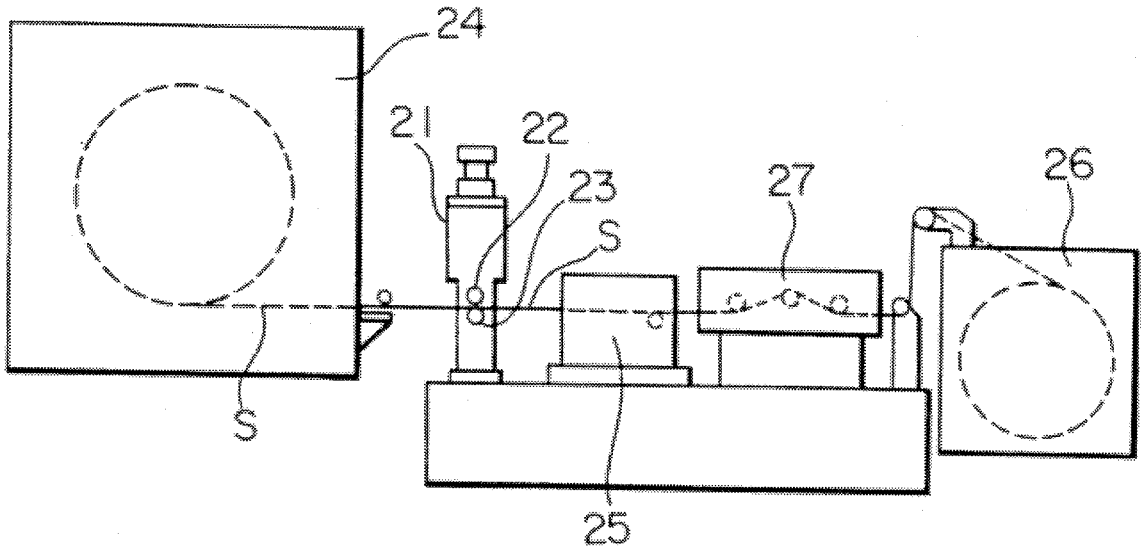
FIG. 5 is a schematic view showing a rolling wear test apparatus used in Example 2.
Figure 6:
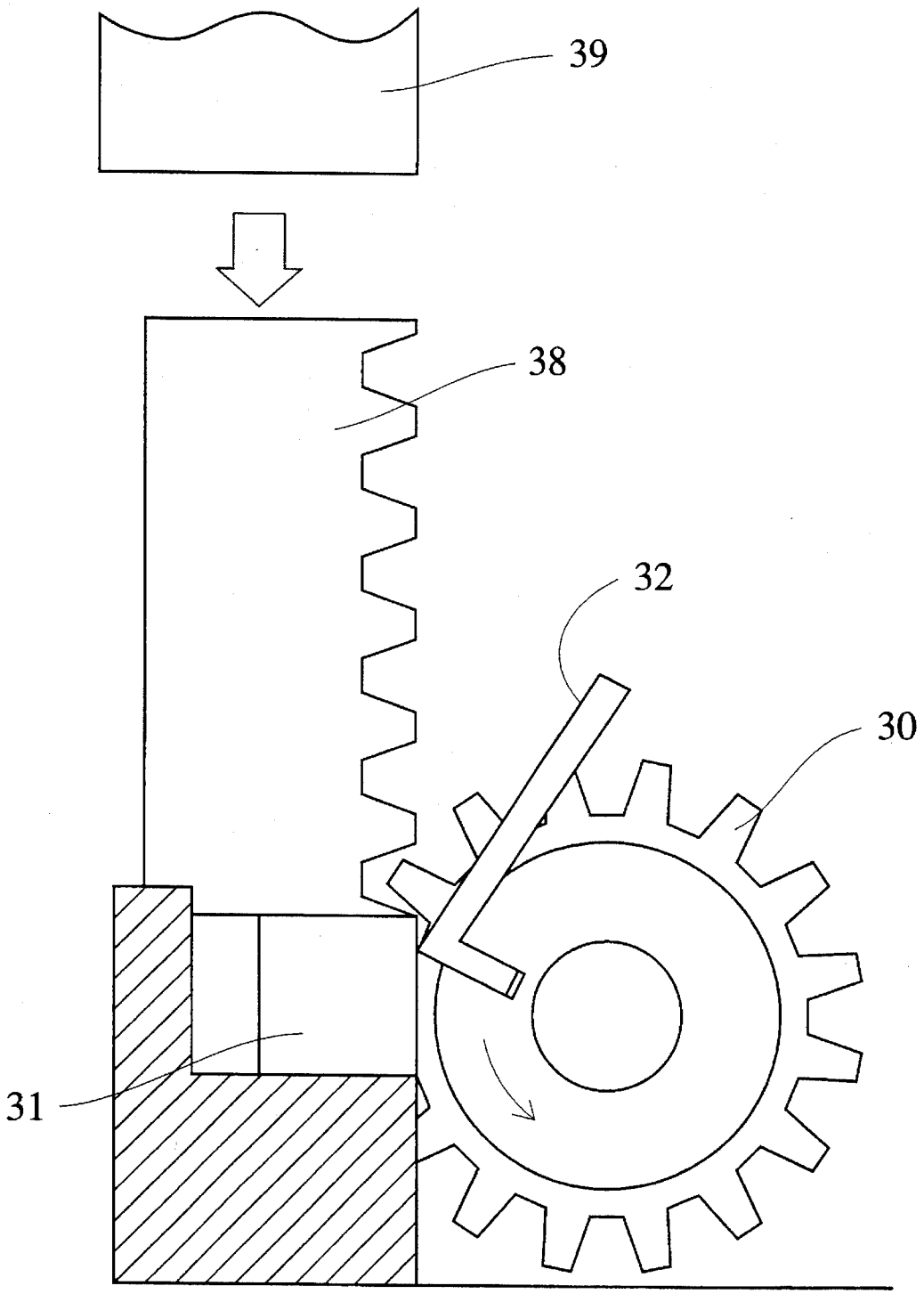
FIG. 6 is a schematic view of a frictional-heat shock test apparatus used in Example 2.

Small sleeve rolls of 60 mm outer layer, 40 mm inner layer and 40 mm width prepared from the test rolls Nos. 2 and 5 were subjected to rolling wear test using the rolling wear test apparatus shown in FIG. 5 and seizing test using the frictional-heat shock test apparatus shown in FIG. 6. Further, the same tests were conducted on the sleeve rolls formed, from the test roll No. 8 (grain roll) and test roll No. 9 (high speed steel roll). Wear resistance of each roll was evaluated by the wear depth after repeating the test three times.

The rolling wear test apparatus comprises a rolling mill 21, an upper roll 22 and a lower roll 23 in the rolling mill 21, a heating furnace 24 for preheating a sheet S to be rolled, a cooling water bath 25 for cooling the rolled S, a reel 26 for giving a constant tension to the sheet during rolling operation, and a tension controller 27 for adjusting the tension. The test conditions were as follows:

Sheet to be rolled: SUS304 1 mm thick and 15 mm wide

Rolling reduction: 25%

Rolling speed: 150 m/minute

Rolling temperature: 900° C.

Rolling distance: 300 m

Roll cooling: Water cooling

Number of rolls: Four

In the frictional-heat shock test apparatus shown in FIG. 6, a weight 39 is allowed to fall onto a rack 38 to rotate a pinion 30, thereby bringing a biting member Into strong contact with the surface of a test piece 31.

The results are shown in Table 2. The wear depth of each roll of the present invention as about ¼ of that of the grain cast iron roll, and was equal to that of the high speed steel roll. With respect to the seizing area ratio, the ratio of each roll of the present invention was nearly the same as that of the grain cast iron roll, and about 60% of that of the high speed steel roll. These results show that seizing resistance increases with increasing graphite amount.

As mentioned above, the roll of the present invention is comparable to the conventional cast iron roll in seizing resistance, and is 4 times higher than it in wear resistance. Further, the roll of the present invention shows more improved seizing resistance as compared with the high speed steel roll having little graphite.

TABLE 2

| Test roll No. | Area ratio of Graphite (%) | Area ratio of MC carbides (%) | Area ratio of Carbide (%) |
|---|---|---|---|
| 2 | 2.7 | 5.5 | 24.1 |
| 5 | 2.2 | 4.7 | 23.8 |
| 8(1) | 2.5 | — | 38.6 |
| 9(2) | — | 7.3 | 20.7 |

| Test roll No. | Ratio of seizing area (%) | Wear depth (μm) |
|---|---|---|
| 2 | 41 | 6 |
| 5 | 40 | 7 |
| 8(1) | 38 | 27 |
| 9(2) | 63 | 7 |

Note:
(1)Grain roll
(2)High speed steel roll

EXAMPLE 3

By using melt having same composition as test roll No. 2 in Example 1, a compound roll of 600 mm outer diameter and 1800 mm roll length was produced by the continuous shell casting apparatus shown in FIG. 1. The melt temperature was 1580° C. and the pouring temperature was 1350° C. A Ca—Si inoculant was injected, as shown in FIG. 1, into melt held in the refractory mold 1 by wire injection method. S i amount inoculated was 0.2 weight %. The compound roll thus ed was subjected to stress relief annealing, hardening from 1100° C., and then tempering three times at 550° C. for 20 hours.

The compositions of the outer layer at 5 mm depth, 25 mm depth and 50 mm depth of the upper casting portion, mid casting portion and lower casting portion of the roll barrel were examined. The results are shown in Table 3. Further, the observation of metal structures of the same portions as above showed the results of 2.0–3.0% of graphite area ratio, 4.5–5.5% of MC carbides area ratio and 20–25% if the total carbides ratio (MC carbide, $M_2C$ carbides, $M_6C$ carbide and cementite). These results are nearly the same as those of Example 1, and demonstrates the excellency of the compound roll of the present invention in wear resistance and seizing resistance.

TABLE 3

(weight %)

| Portion | C | Si | Mn | Ni |
|---|---|---|---|---|
| Upper casting portion | | | | |
| 5 mm | 3.04 | 2.10 | 0.48 | 0.90 |
| 25 mm | 3.00 | 2.08 | 0.47 | 0.88 |
| 50 mm | 2.98 | 2.08 | 0.47 | 0.88 |
| Mid casting portion | | | | |
| 5 mm | 2.99 | 1.96 | 0.48 | 0.91 |
| 25 mm | 3.05 | 1.98 | 0.49 | 0.87 |
| 50 mm | 3.02 | 1.98 | 0.50 | 0.88 |
| Lower casting portion | | | | |
| 5 mm | 3.01 | 1.92 | 0.51 | 0.90 |
| 25 mm | 2.99 | 1.88 | 0.48 | 0.91 |
| 50 mm | 2.99 | 1.91 | 0.47 | 0.95 |

| Portion | Cr | Mo | V | W |
|---|---|---|---|---|
| Upper casting portion | | | | |
| 5 mm | 2.85 | 2.89 | 4.44 | 2.20 |
| 25 mm | 2.91 | 2.90 | 4.48 | 2.17 |
| 50 mm | 2.95 | 2.90 | 4.47 | 2.11 |
| Mid casting portion | | | | |
| 5 mm | 2.90 | 2.81 | 4.45 | 2.18 |
| 25 mm | 3.02 | 2.85 | 4.46 | 2.08 |
| 50 mm | 2.96 | 2.86 | 4.48 | 2.16 |
| Lower casting portion | | | | |
| 5 mm | 2.84 | 2.85 | 4.51 | 2.22 |
| 25 mm | 2.93 | 2.78 | 4.53 | 2.19 |
| 50 mm | 2.95 | 2.77 | 4.51 | 2.26 |

INDUSTRIAL APPLICABILITY

By coexisting graphite articles and hard carbides, it has been made possible to provide rolls for hot rolling having both wear resistance and seizing resistance. Such rolls are highly efficient particularly used in the latter stand of a finishing train of a hot strip mill. With such rolls, the productivity in the rolling manufacture can be increased.

We claim:

1. A wear- and seizing-resistant roll for hot rolling, which has a composition consisting essentially, by weight, of 2.0–4.0% of C, 0.5–4.0% of Si, 0.1–1.5% of Mn, 1.0–7.0% of Cr, 2.0–10.0% of Mo, 2.0–8.0% of V and balance of Fe and inevitable impurities, and has a metal structure comprising a matrix, 0.5–5% in area ratio of graphite, 0.2–10% in area ratio of MC carbides and 40% or less in area ratio of cementite.

2. The wear- and seizing-resistant roll for hot rolling according to claim 1, wherein said metal structure further contains in addition to said MC carbides at least one carbide of $M_2C$ carbides, $M_6C$ carbides and $M_7C_3$ carbides in an area ratio of 0.2–20%.

3. The wear- and seizing-resistant roll for hot rolling according to claim 1 or 2, wherein said matrix substantially comprises martensite, bainite or pearlite.

4. The wear- and seizing-resistant roll for hot rolling according to any one of claims 1–3, wherein said composition further consists essentially, by weight, of at least one of 0.2–4.0% of Ni, 2.0–10.0% of W, 1.0–10.0% of Co, 1.0–10.0% of Nb, 0.01–2.0% of Ti, 0.002–0.2% of B and 0.02–1.0% of Cu.

5. The wear- and seizing-resistant roll for hot rolling according to any one of claims 1–3, wherein said roll has a composition consisting essentially, by weight, of 2.0–4.0% of C, 0.5–4.0% of Si, 0.1–1.5% of Mn, 1.0–7.0% of Cr, 2.0–10.0% of Mo, 2.0–8.0% of V, 0.2–4.0% of Ni, 2.0–10.0% of W, balance of Fe and inevitable impurities, and at least one of 1.0–10.0% of Co, 1.0–10.0% of Nb, 0.01–2.0% of Ti, 0.002–0.2% of B and 0.02–1.0% of Cu.

6. A wear- and seizing-resistant compound roll for hot rolling, which comprises an outer layer of a wear- and seizing-resistant iron-based alloy and a steel shaft metallurgically bonded to the outer layer, the iron-based alloy having a composition consisting essentially, by weight, of 2.0–4.0% of C, 0.5–4.0% of Si, 0.1–1.5% of Mn, 1.0–7.0% of Cr, 2.0–10.0% of Mo, 2.0–8.0% of V and balance of Fe and inevitable impurities, and having a metal structure comprising a matrix, 0.5–5% in area ratio of graphite, 0.2–10% in area ratio of MC carbides and 40% or less in area ratio of cementite.

7. The wear- and seizing-resistant compound roll for hot rolling according to claim 6, wherein said metal structure of said outer layer further contains in addition to said MC carbides at least one carbide of $M_2C$ carbides, $M_6C$ carbides and $M_7C_3$ carbides in an area ratio of 0.2–20%.

8. The wear- and seizing-resistant compound roll for hot rolling according to claim 6 or 7, said matrix of said outer layer substantially comprises martensite, bainite or pearlite.

9. The wear- and seizing-resistant compound roll for hot rolling according to any one of claims 6–8, wherein said iron-based alloy of said outer layer further contains by weight, of at least one of 0.2–4.0% of Ni, 2.0–10.0% of W, 1.0–10.0% of Co, 1.0–10.0% of Nb, 0.01–2.0% of Ti, 0.002–0.2% of B and 0.02–1.0% of Cu.

10. The wear- and seizing-resistant compound roll for hot rolling according to any one of claims 6–9, wherein said outer layer has a composition consisting essentially, by weight, of 2.0–4.0% of C, 0.5–4.0% of Si, 0.1–1.5% of Mn, 1.0–7.0% of Cr, 2.0–10.0% of Mo, 2.0–8.0% of V, 0.2–4.0% of Ni, 2.0–10.0% of W, balance of Fe and inevitable impurities, and at least one of 1.0–10.0% of Co, 1.0–10.0% of Nb, 0.01–2.0% of Ti, 0.002–0.2% of B and 0.02–1.0% of Cu.

11. A method of producing a wear- and seizing-resistant compound roll for hot rolling, which comprises an outer layer of a wear- and seizing-resistant iron-based alloy and a steel shaft metallurgically bonded to the outer layer, the iron-based alloy having a composition consisting essentially, by weight, of 2.0–4.0% of C, 0.5–4.0% of Si, 0.1–1.5% of Mn, 1.0–7.0% of Cr, 2.0–10.0% of Mo, 2.0–8.0% of V and balance of Fe and inevitable impurities, and having a metal structure comprisingly a matrix, 0.5–5% in area ratio of graphite, 0.2–10% in area ratio of MC carbides and 40% or less in area ratio of cementite, wherein in Si-containing inoculant is supplied into a melt of material for said outer layer at least in a vicinity of a bonding portion of said melt and said steel shaft.

12. The method of producing a wear- and seizing-resistant compound roll for hot rolling according to claim 11, wherein said Si-containing inoculant is injected into the vicinity of the bonding portion of said melt and said steel shaft by means of wire-injection method.

13. The method of producing a wear- and seizing-resistant compound roll for hot rolling according to claim 11 or 12, wherein said method comprises the steps of:

introducing said steel shaft concentrically into an inner space of a composite mold comprising a refractory mold surrounded by an induction heating coil and a cooling mold provided under said refractory mold concentrically therewith;

pouring said melt of the iron-based alloy into a space between said steel shaft and said composite mold;

keeping said melt at a temperature between a primary crystal-crystallizing temperature and a temperature 100° C. higher than said primary crystal-crystallizing temperature heating with stirring while sealing the surface of said melt by a flux;

moving said steel shaft downward concentrically with said composite mold to bring said melt into contact with said cooling mold thereby solidifying said melt to bond to said steel shaft so that said outer layer is continuously formed on said steel shaft body, during the formation of said layer an Si-containing inoculant being injected by means of wire-injection method into said vicinity of the bonding portion said melt and said steel shaft to crystallize graphite particles in a amount.

14. The method of producing a wear- and seizing-resistant compound roll for hot rolling according to any one of claims 11–13, wherein said Si-containing inoculant is Ca—Si alloy.

* * * * *

UNITED STATES PATENT AND TRADEMARK OFFICE

CERTIFICATE OF CORRECTION

PATENT NO. : 5,514,065

DATED : May 7, 1996

INVENTOR(S) : NODA et al.

It is certified that error appears in the above-indentified patent and that said Letters Patent is hereby corrected as shown below:

Claim 13, column 12, lines 40 after "portion" insert –of–; and line 41, before "amount" insert –sufficient–.

Signed and Sealed this

Sixth Day of August, 1996

*Attest:*

*Attesting Officer*

BRUCE LEHMAN

*Commissioner of Patents and Trademarks*